US007749148B2

(12) United States Patent
Mackel et al.

(10) Patent No.: US 7,749,148 B2
(45) Date of Patent: Jul. 6, 2010

(54) SEPARATOR DRUM HAVING A SCREW CONNECTION

(75) Inventors: Jürgen Mackel, Oelde (DE); Norbert Wegener, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 11/883,557

(22) PCT Filed: Jan. 31, 2006

(86) PCT No.: PCT/EP2006/050558

§ 371 (c)(1),
(2), (4) Date: May 12, 2008

(87) PCT Pub. No.: WO2006/084806

PCT Pub. Date: Aug. 17, 2006

(65) Prior Publication Data

US 2009/0054223 A1 Feb. 26, 2009

(30) Foreign Application Priority Data

Feb. 8, 2005 (DE) ..... 10 2005 005 660

(51) Int. Cl.
*B04B 1/10* (2006.01)
*B04B 7/08* (2006.01)

(52) U.S. Cl. ..... 494/70

(58) Field of Classification Search ..... 494/2–4, 494/64–73; 210/360.1–380.3
See application file for complete search history.

(56) References Cited

U.S. PATENT DOCUMENTS

| | | | | |
|---|---|---|---|---|
| 565,278 | A * | 8/1896 | Kimball | 494/43 |
| 565,279 | A * | 8/1896 | Kimball | 494/64 |
| 1,356,274 | A | 10/1920 | Edmonds et al. | |
| 2,369,222 | A | 2/1945 | Every | |
| 3,708,111 | A * | 1/1973 | Sheeler et al. | 494/37 |
| 3,730,422 | A * | 5/1973 | Cho | 494/74 |
| 3,843,045 | A * | 10/1974 | Schmidt et al. | 494/27 |
| 3,899,128 | A * | 8/1975 | Joyce | 494/67 |
| 4,191,325 | A * | 3/1980 | Stroucken et al. | 494/40 |
| 4,710,160 | A * | 12/1987 | Klintenstedt et al. | 494/64 |
| 4,930,412 | A | 6/1990 | Stroucken | |
| 4,976,678 | A * | 12/1990 | Suginaka et al. | 494/68 |
| 5,000,730 | A | 3/1991 | Back | |
| 7,331,919 | B2 * | 2/2008 | Niemerg | 494/40 |
| 2009/0054223 | A1 * | 2/2009 | Mackel et al. | 494/27 |

FOREIGN PATENT DOCUMENTS

| | | |
|---|---|---|
| DE | 35 11 422 A1 | 1/1986 |
| DE | 39 36 165 A1 | 5/1990 |
| DE | 39 10 302 C1 | 6/1990 |
| EP | 0 309 478 B1 | 4/1989 |
| EP | 0 312 233 B1 | 4/1989 |

* cited by examiner

*Primary Examiner*—Charles E Cooley
(74) *Attorney, Agent, or Firm*—Barnes & Thornburg LLP

(57) ABSTRACT

A separator drum for a separator having a vertical rotational axis. The separator drum includes an upper drum section, a lower drum section, and a screw connection formed between the upper end lower drum sections without a locking ring. The upper drum section is screwed into the lower drum section or the lower drum section is screwed into the upper drum section. A portion of the upper drum section adjacent the screw connection engages behind a portion of the lower drum section adjacent the screw connection in a manner of a clamping device.

4 Claims, 2 Drawing Sheets

SEPARATOR DRUM HAVING A SCREW CONNECTION

BACKGROUND

The present disclosure relates to a separator drum.

In separators having a vertical rotational axis, product is generally supplied to the separator drum along the machine axis through an intake pipe and radial distribution channels positioned downstream from said pipe. In the separator drum the product enters a disk stack comprised of conical or separator disks, generally arranged close to one another, and spaced somewhat from one another. Heavier solids generally settle out on the bottom side of the separator disk and travel toward the outer periphery of the disk stack, while the liquid flows inward, for example, in a two-phase liquid/solid separation. Solids are frequently removed via nozzles or via solid material discharge openings that have piston valves connected upstream.

The drum with a vertical rotational axis generally comprises a lower drum section and an upper drum section or cover section, which are screwed to one another by a separate locking ring. This type of construction is known, for example, from DE 35 11 422 or from DE 39 36 165 A1. A direct insertion of the lower drum section into the upper drum section, see, for example, U.S. Pat. No. 2,369,222 or EP 0 312 233 B1, can lead to indefinite operating conditions. That is because the currently customary high operating speeds of up to 10,000 rpm can cause the drum sections to expand too much, which in turn can lead to a lack of precise guidance of the parts in relation to one another. This is also true of the idea of a direct screw connection between a lower drum section and a cover. Constructions of this type are used in the centrifuge of EP 0309 478 B1 and the generic separator of U.S. Pat. No. 1,356,274.

Nevertheless, a functional direct connection between the upper drum section, also called the drum cover, and the lower drum section that does not require a centering ring and is fully functional even at higher rotational speeds would be of great interest.

The present disclosure relates to the above-stated problem.

The present disclosure thus relates to a separator drum for a separator with a vertical rotational axis.

The present disclosure provides for a separator drum for a separator with a vertical rotational axis. The separator drum includes an upper drum section and a lower drum section, wherein a screw connection or threaded connection is formed between the upper drum section and the lower drum section. Either the upper drum section is screwed directly into the lower drum section, or the lower drum section is screwed directly into the upper drum section, without a locking ring. In each case the respective inner drum section in the vicinity of the screw connection clamps or engages behind the outer drum section on the outside in the vicinity of a clamping element. Stated another way, the separator drum includes an upper drum section, a lower drum section, and a screw connection formed, without a locking ring, between the upper and lower drum sections by either the upper drum section being screwed into the lower drum section or the lower drum section being screwed into the upper drum section. A portion of the upper drum section adjacent the screw connection engages behind a portion of the lower drum section adjacent the screw connection in a manner of a clamping element.

The above-noted structure of the separator drum of the present disclosure has advantages.

For example, a locking ring is eliminated as a separate component, making the solution cost-effective.

Additionally, the penetration of dirt is reliably prevented by the configuration of the threaded area.

Furthermore, a clamping element counteracts the centrifugal expansion, especially of the lower drum section, and ensures a centering and guidance of the load-bearing drum sections in relation to one another.

Embodiments of the present disclosure are discussed herein.

A centering ring that clamps or engages behind the drum section on the outside is known from PCT/SE/00249. However, this publication does not disclose a direct clamping combined with a screw connection.

The surfaces of the upper drum section and the lower drum section that rest against one another in the vicinity of the clamping element are conical or cylindrical in structure.

In constructive terms, it is advantageous for the upper drum section to be screwed into the lower drum section and to have a lower projection, which engages behind an upper ring collar on the outside of the lower drum section to form the clamping element or connection. The upper drum section is preferably conical in shape on the exterior and the interior, with its lower area transitioning into a segment that is cylindrical at least on its outer periphery. It is further preferable for the lower drum section to be conical in shape on the exterior and the interior, with its upper area transitioning into a segment that is cylindrical on the exterior and the interior.

With such an embodiment, preferably piston valves and/or other discharge systems can be easily used. This is despite the simplified connection between the lower drum section and the upper drum section.

The structure of the lower drum section can be simplified because it no longer requires a contact point for the drum cover. Based upon the outer diameter of the drum, the outer diameter of the drum seal can also be enlarged. This results in an improved utilization of the space inside the drum.

Other aspects of the present disclosure will become apparent from the following descriptions when considered in conjunction with the accompanying drawings.

DETAILED DESCRIPTION

Figure 1:
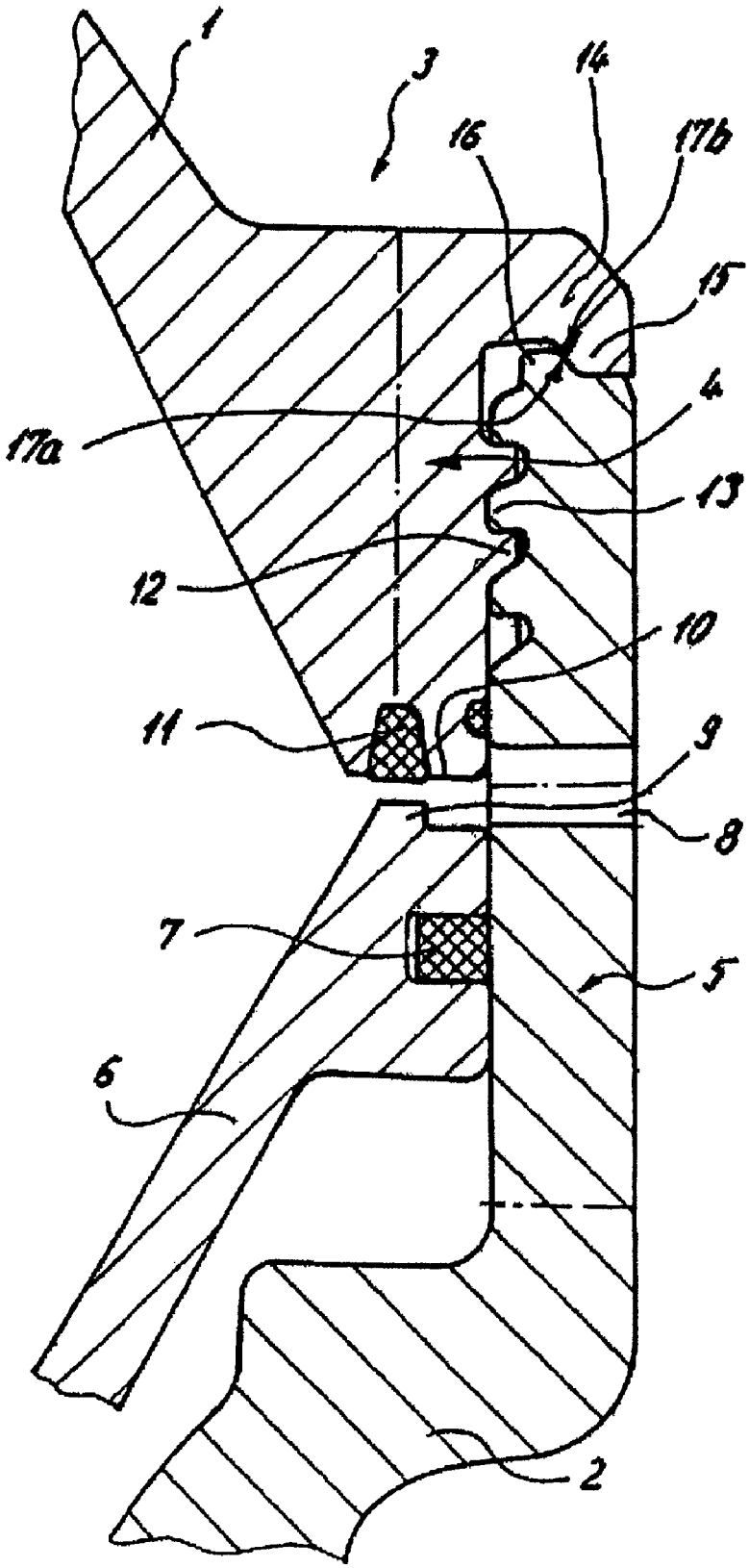
FIG. 1 is a sectional view of the area of connection between the upper drum section and the lower drum section of a first separator drum, according to the present disclosure.

FIG. 1 shows an area of connection between the upper drum section 1 and the lower drum section 2 of a separator drum 3, according to the present disclosure. The drum 3 has a vertical rotational axis (not shown).

The upper drum section 1 and the lower drum section 2 are both conical in shape. Each section 1 and 2 transitions, in the area in which its diameter is largest, into a segment 4 and a segment 5, respectively, that is cylindrical on its outer periphery (upper drum section 1) or on its outer periphery and its inner periphery.

The lower drum section 2 has cylindrical segment 5 that is somewhat longer axially, and in which a piston valve 6 with a circumferential seal 7 is guided so as to be displaceable axially. The piston valve 6 serves to open and seal solid material discharge openings 8 in the lower drum section 2.

FIG. 1 shows the solid material discharge openings 8 in the opened state.

When the solid material discharge openings 8 are in the closed state (not shown), the piston valve 6 is positioned with its upper annular surface 9 against a lower collar 10 of the upper drum section or on a ring seal 11 in collar 10.

The segment 4 of the upper drum section 1, that is cylindrical on the exterior and conical on the interior, is dimensioned such that it engages axially in the cylindrical segment 5 of the lower drum section 2.

On the outer periphery of the cylindrical segment 4 of the upper drum section 1, and on the inner periphery of the cylindrical segment 5 of the lower drum section 2, a respective exterior threading and interior threading 12, 13, respectively, is formed. Thus, the upper drum section 1 is screwed into the lower drum section 2.

On an upper rim of the cylindrical segment 5 of the lower drum section 2, a ring collar 14, that projects radially outward as part of the upper drum section 1, rests against an outermost periphery of the lower drum section 2, above the area of the screw connection. This ring collar 14 has, in its outermost area, at least one projection 15 that extends axially downward and encompasses a ring collar 16 located on the lower drum section 2, and which ring collar 16 projects axially upward above the area of the screw connection. The projection 15 can be configured as a continuous ring collar, or can comprise multiple sections or areas that are arranged or distributed around the circumference of the upper drum section 1 (not shown).

Figure 2:
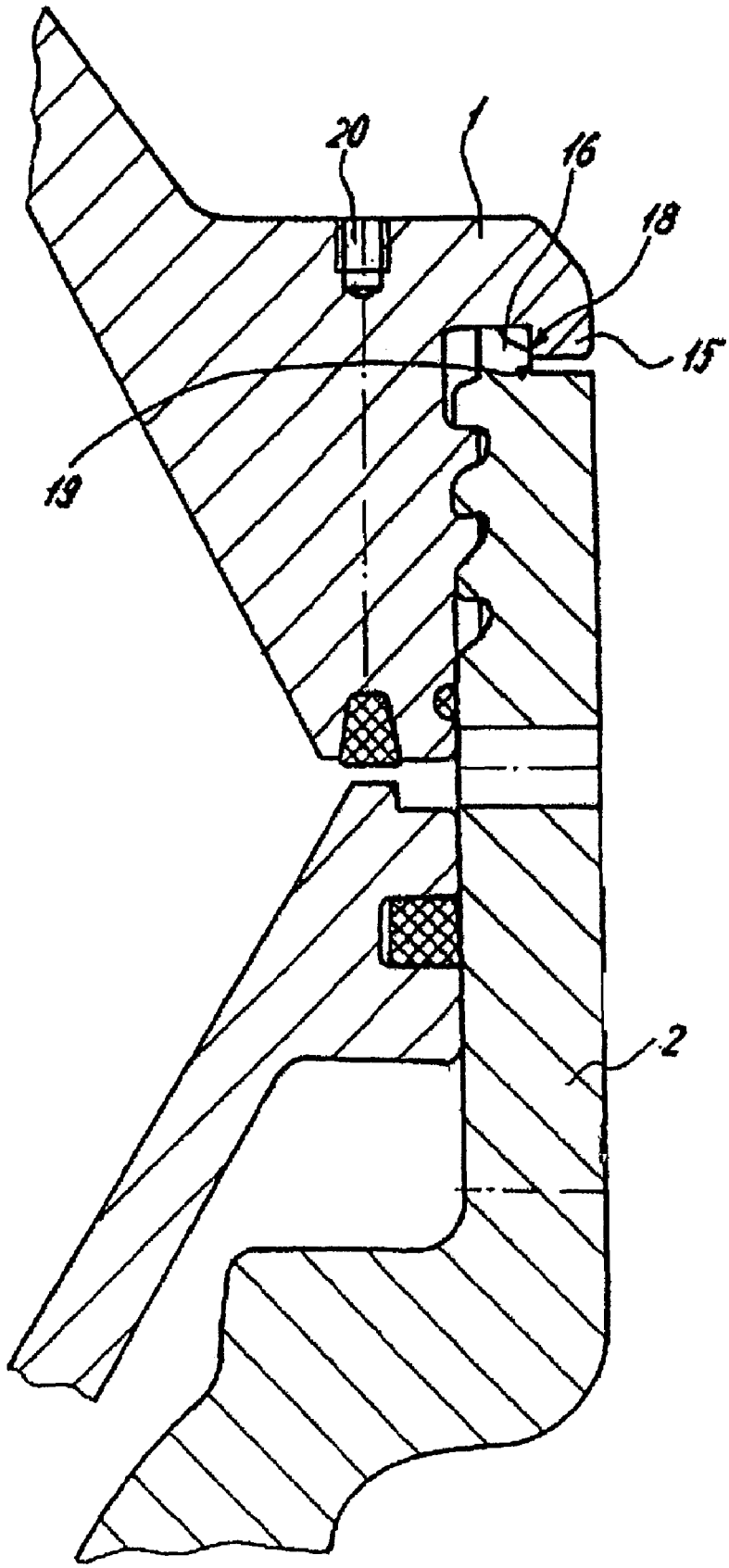
FIG. 2 is a sectional view of the area of connection between the upper drum section and the lower drum section of a second separator drum, according to the present disclosure.

As shown in FIG. 2, a penetration depth is limited in an axial direction by the positioning of the two sections in the cone or surfaces 17*a*, 17*b* (see FIG. 1).

In this manner, a direct screw connection that requires no locking ring is achieved between the lower drum section 2 and the upper drum section 1. Problems are effectively prevented from occurring in the area of the screw connection as a result of the expansion of the lower drum section 2 from rotation during operation.

In the embodiments shown in both FIGS. 1 and 2, it is essential that the projection 15, regardless of whether it is ring-shaped or in sections distributed around the circumference, engages behind the lower drum section 2. Such engagement may be preferable behind the upper ring collar 16 on the outside in a manner of a clamping element.

As shown in FIG. 1, the projection 15 and the ring collar 16 are conical in structure on surfaces 17*a, b* that face one another, which serves to limit the penetration depth. Whereas, in FIG. 2 in this area, cylindrical surfaces 18, 19 are formed, which extend axially.

Both variants noted above have advantages, with the conical surfaces 17*a, b* creating a particularly well-sealed rear engagement, since these conical surfaces run up onto one another with expansion.

Ordinarily, the lower drum section 2 and the upper drum section 1 are screwed together on a locking ring. Because the locking ring is eliminated here, and because there is a large enough surface on the upper drum section 1 for attachment of a corresponding screwing tool (not shown), it is practical, according to a further embodiment, to provide the upper drum section 1 directly with a means for attaching a tool of this type. As a means of this type, FIG. 2 discloses a bore hole 20 in the upper drum section 1. In this bore hole 20, and optionally in one or more additional bore holes (not shown), corresponding bolts can be used to fasten the tool, for example, a type of handle not shown), for screwing the two drum sections 1, 2 to one another. During operation, the bore hole 20 can be sealed, for example, with a threaded bolt, which is then removed to allow placement and fastening of the tool during non-operation of the centrifuge.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A separator drum for a separator having a vertical rotational axis, the separator drum comprising:

an upper drum section;

a lower drum section;

a screw connection formed, without a locking ring, between the upper and lower drum sections by either the upper drum section being screwed into the lower drum section or the lower drum section being screwed into the upper drum section;

a portion of the upper drum section adjacent the screw connection engages behind a portion of the lower drum section adjacent the screw connection in a manner of a clamping element;

wherein surfaces of the upper drum section and the lower drum section rest against one another in the vicinity of the clamping element and the surfaces are conical in shape on a side of each section opposite threads located on and connecting the upper and lower drum sections;

wherein the upper drum section is conical in shape on an exterior and an interior, and transitions in a lower area of the upper drum section into a segment that is cylindrical at least on its outer periphery;

wherein the lower drum section is conical in structure on an exterior and interior of the lower drum section, and transitions in an upper area of the lower drum section into a segment that is cylindrical on the exterior and the interior of the drum section;

wherein an exterior threading is formed on an outer periphery of the cylindrical segment of the upper drum section, and an interior threading is formed on an inner periphery of the cylindrical segment of the lower drum section, so that the upper drum section is screwed into the lower drum section and a projection on the upper drum section and a ring collar on the lower drum section lie completely above the screw connection.

2. The separator drum according to claim 1, wherein a piston valve is guided in the cylindrical segment of the lower drum section so as to be axially displaceable, and the piston valve serves to open and to close solid material discharge openings in the lower drum section.

3. The separator drum according to claim 1, wherein means for attachment of a tool for screwing the upper drum section to the lower drum section is formed on the upper drum section.

4. The separator drum of claim 3, wherein the means includes at least one bore hole.

* * * * *